US011077694B2

(12) United States Patent
Noso et al.

(10) Patent No.: US 11,077,694 B2
(45) Date of Patent: Aug. 3, 2021

(54) POST-PROCESSING DEVICE

(71) Applicant: KYOCERA Document Solutions Inc., Osaka (JP)

(72) Inventors: Terumitsu Noso, Osaka (JP); Tadahisa Kishimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 112 days.

(21) Appl. No.: 16/365,720

(22) Filed: Mar. 27, 2019

(65) Prior Publication Data

US 2019/0308436 A1 Oct. 10, 2019

(30) Foreign Application Priority Data

Apr. 6, 2018 (JP) ..... JP2018-073829

(51) Int. Cl.

| | |
|---|---|
| ***B42C 1/12*** | (2006.01) |
| ***G03G 15/00*** | (2006.01) |
| ***B42C 3/00*** | (2006.01) |
| ***B65H 29/22*** | (2006.01) |
| ***B65H 37/04*** | (2006.01) |
| ***B41J 13/00*** | (2006.01) |

(52) U.S. Cl.

CPC ..... *B42C 1/12* (2013.01); *B41J 13/0045* (2013.01); *B42C 3/00* (2013.01); *B65H 29/22* (2013.01); *B65H 37/04* (2013.01); *G03G 15/6544* (2013.01)

(58) Field of Classification Search

CPC ..... B41C 1/12
USPC ..... 399/407
See application file for complete search history.

(56) References Cited

U.S. PATENT DOCUMENTS

| | | | | |
|---|---|---|---|---|
| 6,217,016 | B1 * | 4/2001 | Honmochi | B42C 1/12 270/37 |
| 6,268,909 | B1 * | 7/2001 | Honmochi | B65H 45/18 355/25 |
| 8,590,880 | B2 * | 11/2013 | Imazu | B65H 45/148 270/20.1 |
| 8,814,156 | B2 * | 8/2014 | Hattori | B65H 39/10 270/37 |
| 2004/0183249 | A1 * | 9/2004 | Sato | B65H 29/001 271/220 |
| 2011/0103863 | A1 * | 5/2011 | Asami | G03G 15/6541 399/407 |

(Continued)

FOREIGN PATENT DOCUMENTS

JP H11-322163 A 11/1999

*Primary Examiner* — Anthony H Nguyen
(74) *Attorney, Agent, or Firm* — Studebaker & Brackett PC

(57) ABSTRACT

A post-processing device includes a carrying roller, a conveying member, a transporting member and a processing part. The carrying roller is configured to be rotated to carry a sheet one by one to a processing tray along a conveyance direction. The conveying member is configured to convey the sheet carried by the carrying roller to a receiving position on the processing tray. The conveying member has a rotation shaft and a plurality of contact pieces protruding from the rotation shaft so as to come into contact with the sheet carried on the processing tray. The contact piece is made of elastic material. The conveying member is rotated at a rotation speed higher than a rotation speed of the carrying roller when the sheet carried by the carrying roller is conveyed to the receiving position on the processing tray.

13 Claims, 5 Drawing Sheets

(56) References Cited

U.S. PATENT DOCUMENTS

2015/0021145 A1* 1/2015 Sekigawa ..... B65H 31/3045
198/602
2018/0312363 A1* 11/2018 Noso ..... B65H 31/36

* cited by examiner

POST-PROCESSING DEVICE

INCORPORATION BY REFERENCE

This application is based on and claims the benefit of priority from Japanese Patent application No. 2018-073829 filed on Apr. 6, 2018, which is incorporated by reference in its entirety.

BACKGROUND

The present disclosure relates to a post-processing device configured to bind a stack of sheets and fold the bound stack.

A post-processing device configured to bind a stack of sheets and fold the bound stack is sometimes used for forming a booklet. In order to perform a binding processing and a holding processing accurately, it is required to convey the sheets correctly and to form an aligned stack of the sheets.

The post-processing device is provided with a carrying roller, a binding part and a folding part. The carrying roller carries a sheet one by one on a processing tray and conveys it to a predetermined position to form a stack of sheets. The binding part binds the stack. The folding part folds the bound stack. Depending on the type of the sheet, because the carrying roller sometimes does not convey the sheet to the predetermined position, a conveying member is provided so as to assist the conveyance of the sheet carried by the carrying roller to the predetermined position is provided.

As the conveying member, a drive roller and a pickup roller driven by the drive roller may be used. The pickup roller is provided so as to be displaceable between a pressing position where it presses the sheet against the drive roller and is driven to be rotated and a separate position where it separates from the drive roller. Just before the sheet comes into contact with a stopper (before the sheet is conveyed to a binding position), the pickup roller is displaced from the pressing position to the separate position to prevent the sheet from being conveyed excessively.

However, because the above conveying member has a large friction force to the sheet, in a case of a sheet having a large friction force between the sheets, the conveying member may convey the sheet together with the sheet conveyed earlier and the alignment of the sheets at the predetermined position may be disturbed.

SUMMARY

In accordance with an aspect of the present disclosure, a post-processing device includes a carrying roller, a conveying member, a transporting member and a processing part. The carrying roller is configured to be rotated to carry a sheet one by one to a processing tray along a conveyance direction. The conveying member is configured to convey the sheet carried by the carrying roller to a receiving position on the processing tray. The transporting member is configured to transport a stack of the sheets conveyed by the conveying member from the receiving position to a folding position via a binding position on the processing tray. The processing part includes a binding part configured to bind the stack of the sheets at the binding position and a folding part configured to fold the stack of the sheets at the folding position. The conveying member includes at least one first conveying member arranged at an upstream side of the processing part and at least one second conveying member arranged at a downstream side of the processing part in the conveyance direction on the processing tray. Each of the first and second conveying members has a rotation shaft and a plurality of contact pieces protruding from the rotation shaft so as to come into contact with the sheet carried on the processing tray. The contact piece is made of elastic material. The conveying member is rotated at a rotation speed higher than a rotation speed of the carrying roller when the sheet carried by the carrying roller is conveyed to the receiving position on the processing tray.

The above and other objects, features, and advantages of the present disclosure will become more apparent from the following description when taken in conjunction with the accompanying drawings in which a preferred embodiment of the present disclosure is shown byway of illustrative example.

DETAILED DESCRIPTION

Hereinafter, with reference to the attached drawings, a post-processing device according to an embodiment of the present disclosure will be described.

Figure 1:
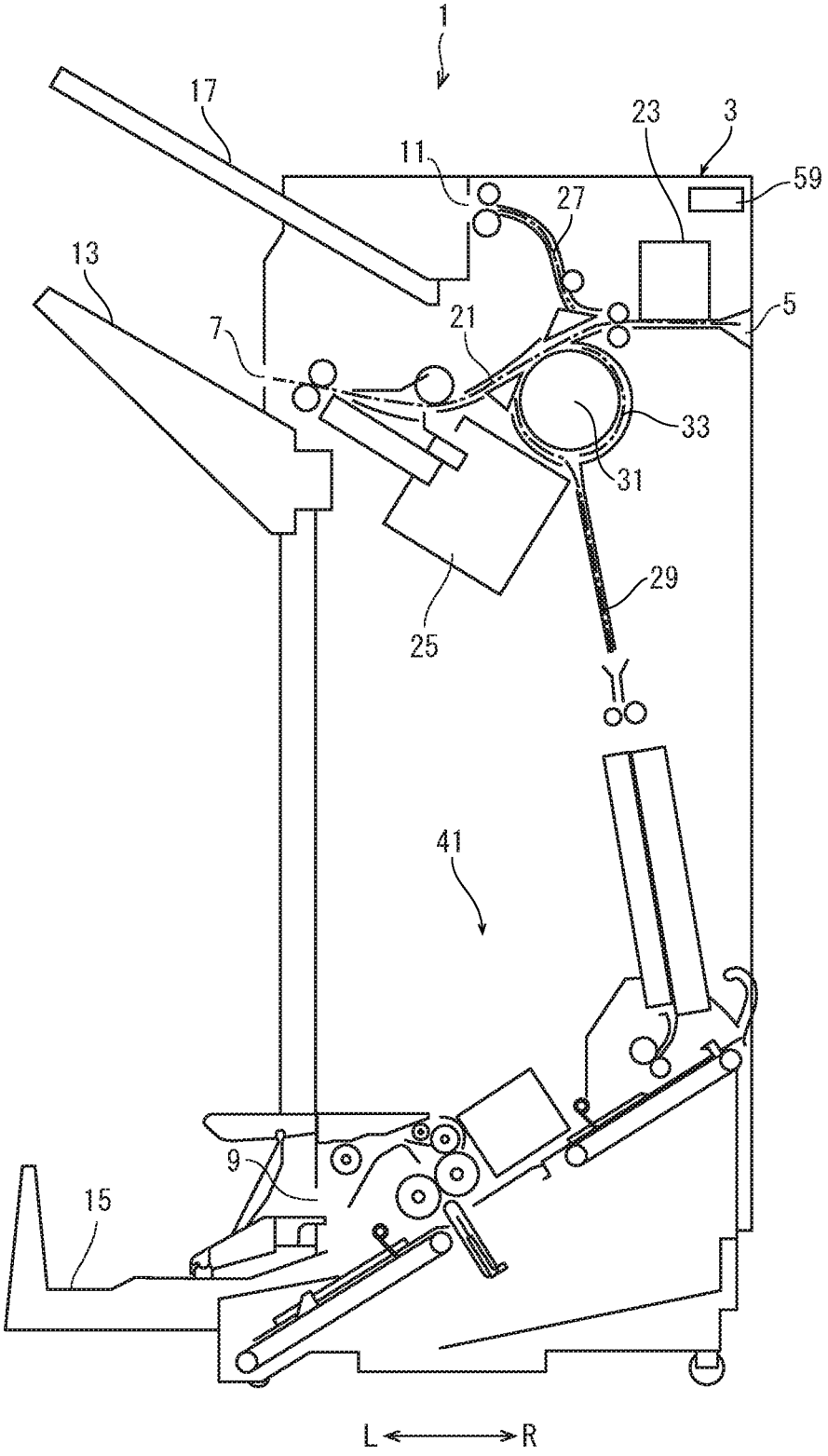
FIG. 1 is a front view schematically showing a post-processing device according to one embodiment of the present disclosure.

First, with reference to FIG. 1, an entire structure of the post-processing device 1 will be described. FIG. 1 is a front view schematically showing the entire structure of the post-processing device. In the following description, a near side of a paper surface of FIG. 1 is defined to be a front side of the post-processing device. Fr, Rr, L and R shown in each figure respectively indicate a front side, a rear side, a left side and a right side of the post-processing device.

The post-processing device 1 has a main body 3. On an upper portion of one side face (a right side face), a sheet receiving port 5 is formed. On an upper portion and a lower portion of the other face (a left side face) of the main body 3, a first discharge port 7 and a second discharge port 8 are respectively formed. On an upper face of the main body 3, a third discharge port 11 is formed. Below the first discharge port 7, a first discharge tray 13 is provided, below the second discharge port 9, a second discharge tray 15 is provided and below the third discharge port 11, a third discharge tray 17 is provided. Inside the main body 3, a conveyance path 21 along which the sheet is conveyed from the sheet receiving port 5 to the first discharge port 7 is provided. Along the conveyance path 21, a punching device 23 and a staple device 25 are provided. The punching device 23 opens a punch hole on the sheet. The staple device 25 binds a stack of the sheets using a staple.

The conveyance path 21 is branched between the punching device 23 and the staple device 25 into a first branch path 27 and into a second branch path 29. The first brunch path 27 extends to the third discharge port 11. The second branch path 29 extends downward through a retraction path 33 formed around a retracting drum 31 for retracting the sheet temporarily. Below the second branch path 29, a folding device 41 configured to bind a stack of the sheets and then to fold the bound stack is provided.

Figure 2:
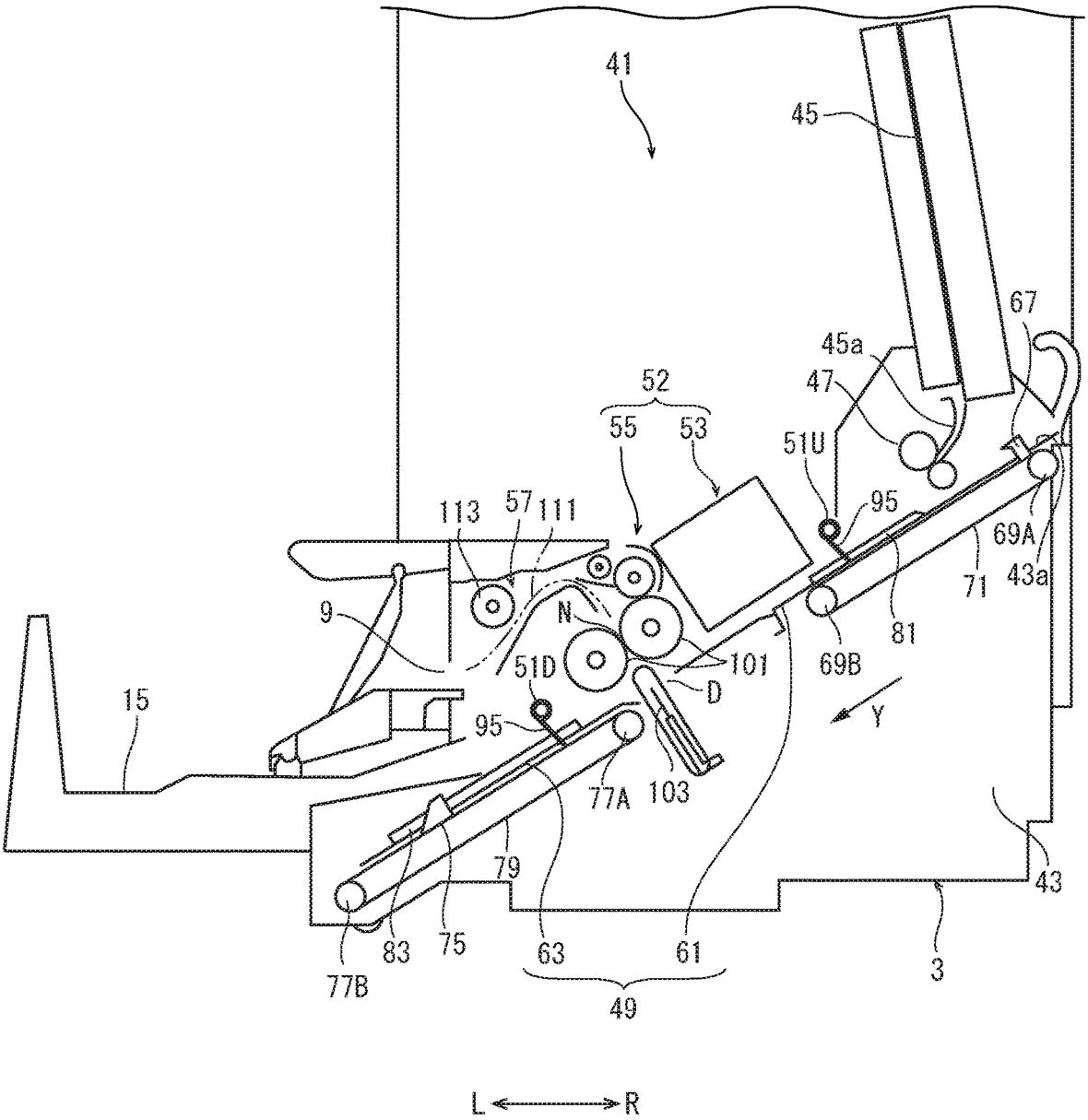
FIG. 2 is a front view schematically showing a folding device according to the embodiment of the present disclosure.
Figure 3:
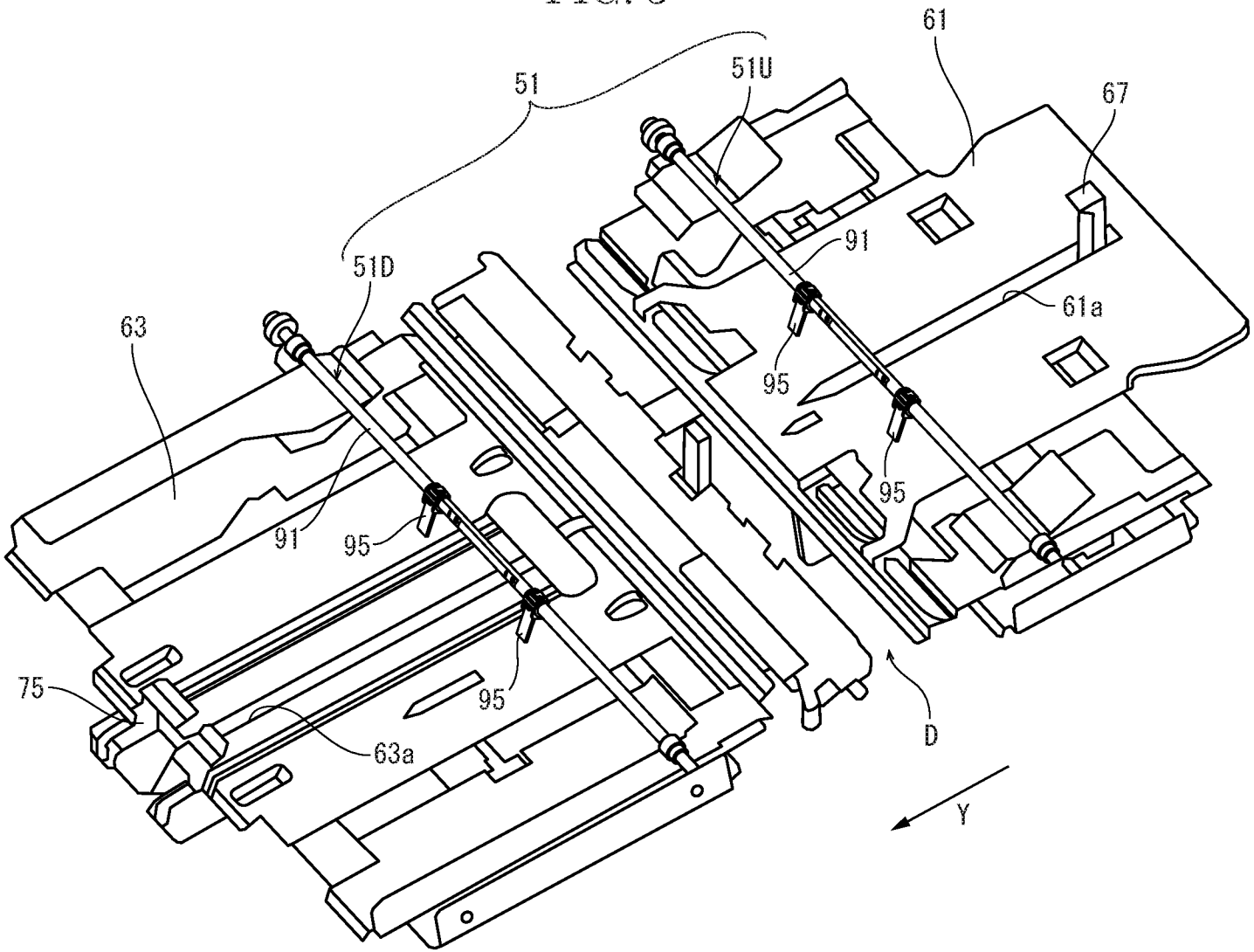
FIG. 3 is a perspective view showing a processing tray of the folding device, in the post-processing device according to the embodiment of the present disclosure.

Next, the folding device 41 will be described with reference to FIG. 2 and FIG. 3. FIG. 2 is a front view schematically showing the folding device and FIG. 3 is a perspective view showing a processing tray of the folding device.

The folding device 41 includes a base part 43, a carrying path 45, a carrying rollers pair 47, a processing tray 49, two conveying members 51 (a first conveying member 51U and a second conveying member 51D), a processing part 52 and a discharge part 57. The base part 43 is provided in a lower portion of the main body 3. The carrying path 45 is provided between the second branch path 29 and the base part 43. The carrying rollers pair 47 is provided at an outlet of the carrying path 45. The processing tray 49 is provided on the base part 43 below the carrying rollers pair 47. The two conveying members 51 are arranged above the processing tray 49. The processing part 52 includes a binding part 53 provided above the processing tray 49 and a folding part 55 provided above and below the processing tray 49. The discharge part 57 is provided above the folding part 55.

The base part 43 has an inclined face 43*a* inclined downward to the other side face (the left side face) of the main body 3.

The carrying path 45 is formed along the upper-and-lower direction between the outlet of the second branch path 29 and an upper end portion of the inclined face 43*a* of the base part 43. A lower end portion 45*a* of the carrying path 45 is inclined in an oblique left lower direction along the inclined face 43*a*. To the carrying path 45, the sheet is carried from the second branch path 29.

The carrying rollers pair 47 includes a drive roller driven by a drive source (not shown) to be rotated and a driven roller driven by the drive roller to be rotated. The drive roller is controlled by a controller 59 (refer to FIG. 1) to be rotated. The carrying rollers pair 47 is arranged at the outlet of the lower end portion 45*a* of the carrying path 45. The carrying rollers pair 47 sends out the sheet from the carrying path 45 in an oblique lower direction along the inclined face 43*a*. In the following description, a direction in which the sheet is sent out by the carrying rollers pair 47 is called a conveyance direction Y.

The processing tray 49 includes an upstream side tray 61 arranged at the upstream side in the conveyance direction Y and a downstream side tray 63 arranged at the downstream side of the upstream side tray 61. The upstream side tray 61 and the downstream side tray 63 respectively have slits 61*a* and 63*a* along the conveyance direction Y at the center in a width direction perpendicular to the conveyance direction Y. The upstream side tray 61 and the downstream side tray 63 are arranged on the inclined face 43*a* of the base part 43 via a predetermined interval D.

On the upstream side tray 61, an upstream side cursor 67 as a transporting member is supported in a movable manner along the conveyance direction Y and a counter direction to the conveyance direction Y. Below an upstream side end and a downstream side end of the upstream side tray 61 in the conveyance direction Y, pulleys 69A and 69B are respectively supported in a rotatable manner. Between the pullers 69A and 69B, an endless belt 71 is wound. The upstream side cursor 67 is mounted to the endless belt 71, and protrudes upward through the slit 61*a* from the upstream side tray 61. When the pullies 69A and 69B are rotated to circulate the endless belt 71, the upstream side cursor 67 is moved along the slit 61*a*. The pullies 69A and 69B are controlled by the controller 59 to be rotated.

On the downstream side tray 63, a downstream side cursor 75 as a transporting member is supported in a movable manner along the conveyance direction Y and the counter direction to the conveyance direction Y. Below an upstream side end and a downstream side end of the downstream side tray 63 in the conveyance direction Y, pulleys 77A and 77B are respectively supported in a rotatable manner. Between the pullers 77A and 77B, an endless belt 79 is wound. The downstream side cursor 75 is mounted to the endless belt 79, and protrudes upward through the slit 63*a* from the downstream side tray 63. When the pullies 77A and 77B are rotated to circulate the endless belt 79, the downstream side cursor 75 is moved along the slit 63*a*. The pullies 77A and 77B are controlled by the controller 59 to be rotated.

Additionally, on the upstream side tray 61 and the downstream side tray 63, pairs of width alignment members 81 and 83 are respectively supported in a movable manner along the with direction.

To the processing tray 49, the sheet sent out by the carrying rollers pair 47 is carried. At this time, a tip edge (a downstream side edge) of the carried sheet comes into contact with the downstream side cursor 75 protruding from the downstream side tray 63 so that the sheet is positioned at a receiving position.

Figure 4:
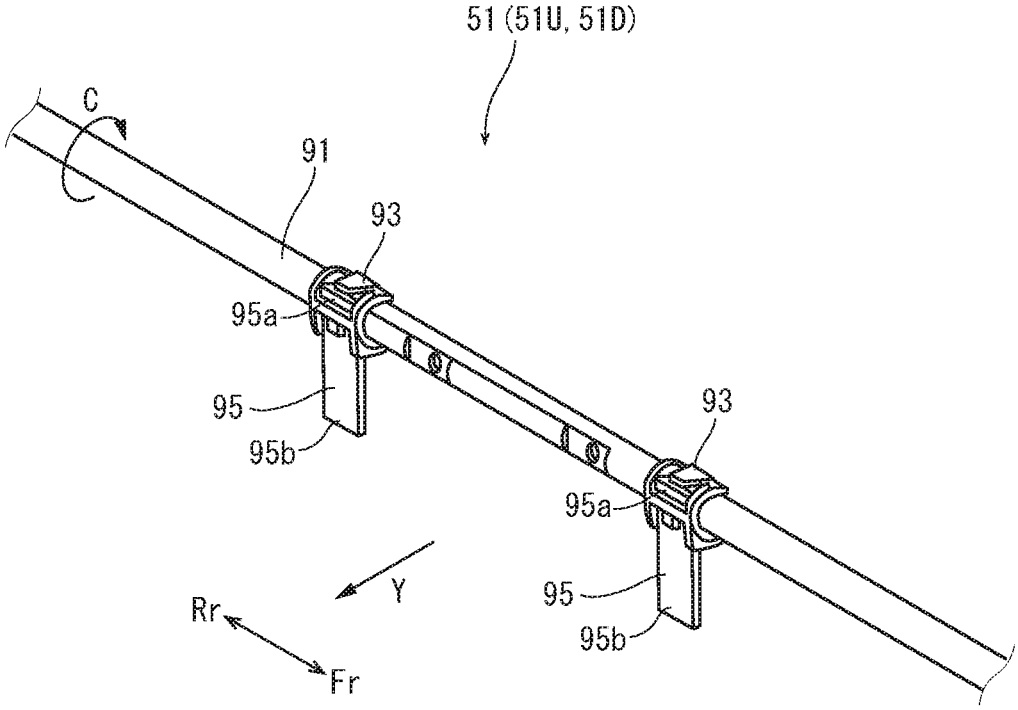
FIG. 4 is a perspective view showing a conveying member, in the post-processing device according to the embodiment of the present disclosure.
Figure 5:
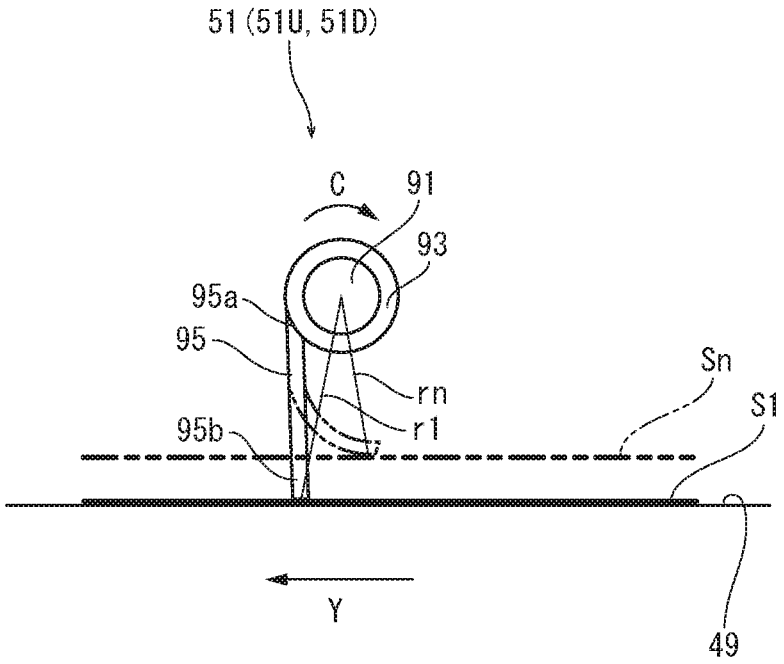
FIG. 5 is a side view showing the conveying member, in the post-processing device according to the embodiment of the present disclosure.

Next, the first and second conveying members 51U and 51D will be described with reference to FIG. 4 and FIG. 5. FIG. 4 is a perspective view showing the conveying member and FIG. 5 is a side view showing the conveying member.

The first and second conveying members 51U and 51D have the same configuration, and each has a rotation shaft 91 and two contact pieces 95 which are fixed to the rotation shaft 91 by fixing members 93 via a predetermined interval. To one end portion of the rotation shaft 91, a drive source (not shown) is connected. The drive source is controlled by the controller 59 to rotate the rotation shaft 91 in a predetermined rotation direction C (the clockwise direction in FIG. 2 to FIG. 5). The contact piece 95 is a rectangular shaped sheet piece, and made of elastic material such as ethylene propylene diene rubber (EPDM). The contact piece 95 has a fixed portion 95*a* at one end side and a tip portion 95*b* at the other end side in its longitudinal direction. The fixed portion 95*a* is fixed to an outer circumferential face of the rotation shaft 91 by the fixing member 93, and the contact piece 95 extends along a tangential line of the outer circumferential face of the rotation shaft 91.

As shown in FIG. 2 and FIG. 3, the first conveying member 51U is arranged above the downstream side portion from the center portion in the conveyance direction Y on the upstream side tray 61 in a posture in which the rotation shaft 91 is parallel to the width direction. The second conveying member 51D is arranged above the upstream side portion from the center portion in the conveyance direction Y on the downstream side tray 63 in a posture in which the rotation shaft 91 is parallel to the width direction. Each rotation shaft 91 is supported at a predetermined height at which the tip portion 95*b* of each contact piece 95 is contactable with each tray. Here, the contact piece 95 of each of the first and second conveying members 51U and 51D takes a posture in which the fixed portion 95*a* fixed to the rotation shaft 91 by the fixing member 93 is positioned at the downstream side of the tip portion 95*b* in the rotation direction C of the rotation shaft 91. That is, each of the first and second conveying members 51U and 51D is rotated in the rotation direction C with the fixed portion 95*a* fixed to the rotation shaft 91 forward. In the other words, in a posture in which each contact piece 95 extends from each rotation shaft 91 toward each processing tray, each conveying member is fixed to the downstream side outer circumferential face of the rotation shaft 91 in the conveyance direction Y.

The first conveying member 51U and the second conveying member 51D are synchronously rotated at the same rotation speed with the same posture, that is, the posture in which the contact piece 95 is fixed to the rotation shaft 91 at the same angle. The controller rotates the first and second conveying members 51U and 51D at the rotation speed higher than that of the carrying rollers pair 47. However, the first and second conveying members 51U and 51D are not necessary to be rotated with the same posture.

With reference to FIG. 2 again, the binding part 53 is a stapler for biding a center portion of a stack of the sheets, and is arranged above the upstream side tray 61 at the downstream side of the first conveying member 51U. The stapler is controlled by the controller to perform the staple processing.

The folding part 55 includes a pair of folding rollers 101 and a folding blade 103 capable of advancing and retracting into and from a nip N between the folding rollers 101. The pair of folding rollers 101 is arranged along the width direction above the interval D between the upstream side tray 61 and the downstream side tray 63. The upstream side folding roller is driven by a drive source (not shown) to be rotated in the clockwise direction in FIG. 2. The downstream side folding roller is biased by a biasing member (not shown) against the upstream side folding roller to form the nip N between the folding rollers 101. The folding blade 103 is driven by a drive mechanism (not shown) to advance and retract through the interval D into and from the nip N between the folding rollers 101. The drive source of the upstream side folding roller and the drive mechanism of the folding blade 103 are controlled by the controller 59 to be driven.

The discharge part 57 includes a discharge path 111 and a discharge roller 113. The discharge path 111 extends upward from the nip N between the folding rollers 101 of the folding part 55 and is inclined to the lower side of the inclined face 43*a* of the base part 43 toward the second discharge port 9. The discharge roller 113 is supported at an outlet of the discharge path 111 in a rotatable manner. The discharge roller 113 is controlled by the controller 59 to be rotated.

Next, an operation for producing a booklet by using the folding device 41 having the above configuration will be described with reference to FIG. 2 mainly. In an initial state, the downstream side cursor 75 is moved to the receiving position at the downstream side of the second conveying member 51D. The upstream side cursor 67 is moved at the upstream side of the carrying rollers pair 47. The width alignment members 81 and 83 are moved at a waiting position outside both side edges of the sheet in the width direction.

When the sheet is conveyed into the carrying path 45 from the second branch path 29, the controller 59 rotates the drive roller of the carrying rollers pair 47 to send out the first sheet conveyed from the carrying path 45 to the processing tray 49. The sent sheet is slid on the processing tray 49 toward the downstream side cursor 75. At this time, the controller 59 rotates the rotation shafts 91 of the first and second conveying members 51U and 51D. This assists the conveyance of the sheet on the processing tray 49. That is, the contact piece 95 of each conveying member is rotated with the tip portion 95*b* contact with the sheet to send out the sheet to the downstream side. The first sheet is conveyed until the tip edge of the sheet comes into contact with the downstream side cursor 75. Then, the downstream side cursor 75 is moved to the upstream side such that the tail edge of the sheet comes into contact with the upstream side cursor 67. Thereby, the sheet is aligned by the upstream side cursor 67 and the downstream side cursor 75 in the conveyance direction Y. Next, the width alignment members 81 and 83 are moved so as to come into contact with the both side edges of the sheet. Thereby, the sheet is aligned in the width direction. During the moving of the downstream side cursor 75 to the upstream side, the first and second conveying members 51U and 51D are rotated such that the contact pieces 95 are separated from the sheet. After the alignment of the sheet, the downstream side cursor 75 is moved to the receiving position and the width alignment members 81 and 83 are moved to the waiting position. During the moving of the downstream side cursor 75 to the receiving position, the first and second conveying members 51U and 51D are rotated to convey the sheet to the downstream side.

After that, the second is sent out from the carrying path 45 by the carrying rollers pair 47. The sent sheet is conveyed by the first and second conveying members 51U and 51D on the first sheet toward the downstream side cursor 75. At this time, because the tip portion 95*b* of the contact piece 95 comes into contact with the sheet, the conveyance of the second sheet is only assisted while the first sheet is kept with the tip edge contact with the downstream side cursor 75. The second sheet is conveyed until the tip edge comes into contact with the downstream side cursor 75, and a stack of the first sheet and the second sheet stacked on the first sheet (hereinafter, called a sheet stack) is formed. Then, the downstream side cursor 75 is moved to the upstream side to transport the sheet stack such that the tail edge of the sheet stack comes into contact with the upstream side cursor 67. Thereby, the sheet stack is aligned by the upstream side cursor 67 and the downstream side cursor 75 in the conveyance direction Y. Next, the width alignment members 81 and 83 are moved so as to come into contact with the both side edges of the sheet stack. Thereby, the sheet stack is aligned in the width direction. During the moving of the downstream side cursor 75 to the upstream side, the first and second conveying members 51U and 51D are rotated such that the contact pieces 95 are separated from the sheet stack. The alignment in the conveyance direction Y by the first and second conveying members 51U and 51D and the alignment in the width direction by the width alignment members 81 and 83 are performed every one sheet.

Then, the sheet stack containing a predetermined number of sheets (for example, 20 sheets) is formed on the processing tray 49. As the number of the sheet is increased, the contact piece 95 is rotated while elastically deformed as shown by a two-dotted chain line in FIG. 5. By the elastic deformation of the contact piece 95, the increase in the thickness of the sheet stack on the processing tray 49 is absorbed.

After that, the center portion of the sheet stack is bound by the stapler. Then, the controller 59 controls the upstream side cursor 67 and the downstream side cursor 75 to be moved so as to transport the sheet stack along the processing tray 49 to a folding position. That is, the upstream side cursor 67 and the downstream side cursor 75 are moved to the downstream until the center portion of the sheet stack in the conveyance direction Y is positioned at the folding position of the folding part (a position corresponding to the nip N between the folding rollers 101). During the moving of the both cursors, the controller 59 controls the rotation shafts 91 of the first and second conveying members 51U and 51D to be rotated such that the contact pieces 95 are separated from the sheet stack.

At the folding position, the folding blade 103 is driven by the drive mechanism to advance through the interval D into the nip N between the folding rollers 101. Thereby, the center portion of the sheet stack is pushed up into the nip N by the folding blade 103, and the sheet stack is pressed from the both side by the upstream side roller and the downstream side roller to be folded. The downstream side roller is displaced against the biasing force by the thickness of the folded sheet stack.

The folding blade 103 retracts at a suitable timing, and the upstream and downstream side rollers of the folding roller 101 are further rotated. Then, the folded sheet stack is discharged from the nip N to the discharge path 111 of the discharge part 57 with the folded center portion forward.

The discharged sheet stack is conveyed along the discharge path 111 by the discharge roller 113, and then discharged through the second discharge port 9 on the second discharge tray 15. As a result, the producing of the booklet is completed.

As described above, according to the post-processing device 1 of the present disclosure, since the first and second conveying members 51U and 51D assist the conveyance of the sheet sent put from the carrying rollers pair 47 to the receiving position, it becomes possible to convey the sheet to the receiving position surely. Additionally, since the sheet is conveyed by the tip portion 95*a* of the sheet shaped contact piece 95, the conveyance of the sheet (the uppermost sheet) coming into contact with the contact piece 95 is assisted while the sheet below the uppermost sheet is not conveyed. Accordingly, it becomes possible to prevent multiple conveyance of the sheet, adhesion of the sheets and buckling of the sheet.

Additionally, during the conveyance of the sheet stack by the upstream side cursor 67 and the downstream side cursor 75, the contact piece 95 is preferably separated from the sheet stack. According to the first and second conveying members 51U and 51D of the present embodiment, by rotating the rotation shaft 91, it becomes possible to separate the contact piece 95 from the sheet stack easily. On the other hands, in a case where a roller is used as the conveying member 51, it becomes necessary to provide a mechanism for moving the conveying member 51. Additionally, the sheet shaped contact piece 95 can be formed in a more inexpensive manner than the roller.

Additionally, the first and second conveying members 51U and 51D are rotated at the rotation speed higher than the rotation speed of the carrying rollers pair 47 so that a frequency of contacting of the contact piece 95 of each conveying member to the sheet is increased to enhance the sheet conveyance performance. Accordingly, it becomes possible to bring the tip edge of the sheet come into the downstream side cursor 75.

When a number of the sheet stacked on the processing tray 49 is increased, a distance between the rotation center of the rotation shaft 91 and the contact position of the contact piece 95 to the uppermost sheet is decreased. That is, as shown in a two-dotted chain line in FIG. 5, the distance rn between the rotation center of the rotation shaft 91 and the contact position of the contact piece 95 to the uppermost sheet Sn is shorter than the distance r1 between the rotation center of the rotation shaft 91 and the first sheet S1. Then, as the number of the sheet stacked on the processing tray 49 is increased, the peripheral speed of the first and second conveying members 51U and 51D is decreased. If the rotation speed of the first and second conveying members 51U and 51D becomes slower than that of the carrying rollers pair 47, the sheet may be buckled between the first and second conveying members 51U and 51D and the carrying rollers pair 47. In the present embodiment, the controller 59 sets the rotation speed of the first and second conveying members 51U and 51D such that the rotation speed of the first and second conveying members 51U and 51D is not slower than that of the carrying rollers pair 47 even if the number of the sheets stacked on the processing tray 49 is increased. In detail, in a case where twenty sheets are stacked on the processing tray 49, the peripheral speed of the first and second conveying members 51U and 51D at the contact position of the contact piece 95 to the uppermost sheet is set to be higher the rotation speed of the carrying rollers pair 47.

Additionally, the first and second conveying members 51U and 51D are synchronously rotated at the same speed so that it becomes possible to convey the sheet stably. However, the first and second conveying members 51U and 51D are not always synchronized completely; they may rotate with a slightly displaced posture.

Next, the modified examples of the conveying member 51 of the present embodiment will be described.

In the first example, the rotation speed of the second conveying member 51D is higher than that of the first conveying member 51U.

The force for sending the sheet by the carrying rollers pair 47 is higher at the side close to the carrying rollers pair 47 than at the side away from the carrying rollers pair 47. Then, by making the rotation speed of the second conveying member 51D higher than that of the first conveying member 51U, the contact frequency of the contact piece 95 to the sheet is increased at the side away from the carrying rollers pair 47, that is, the downstream side. Thereby, it becomes possible to increase the sheet conveyance force at the downstream side and to convey the sheet to the receiving position stably. In this case, the first and second conveying members 51U and 51D are not rotated synchronously.

In the second example, the contact piece of the second conveying member 51D is longer than that of the first conveying member 51U.

In the example, a contact area of the contact piece to the sheet is larger at the second conveying member 51D than at the first conveying member 51U. Thereby, it becomes possible to increase the sheet conveyance force by the contact piece 95 at the downstream side and to convey the sheet to the receiving position stably. In this case, the first and second conveying members 51U and 51D are rotated synchronously.

In order to supplement the decreasing of the sheet sending force by the carrying rollers pair 47 at the downstream side, the number of the second conveying member 51D may be increased more than that of the first conveying member 51U. Alternately, the number of the contact piece 95 of the second conveying member 51D may be increased more than that of the first conveying member 51U. Alternately, the contact piece 95 of the second conveying member 51D is made of a material having a frictional force higher than that of the first conveying member 51U. In these cases, it becomes possible to enhance the sheet conveyance force by the second conveying member 51D.

Alternately, the rotation speed of the conveying member 51 may be varied depending on the sheet condition or the type of sheet. For example, in a case of a sheet requiring a high sheet conveyance force, such as a sheet containing moisture or a sheet on which an image is formed in an inkjet image forming manner, the rotation speed may be preferably increased.

When the post-processing device of the embodiment is coupled to the image forming apparatus of the electrophotographic type or the inkjet type image forming method, it becomes possible to produce a booklet of the sheets on which the image is formed by the image forming apparatus. Alternately, the post-processing device can produce a booklet of the sheet on which the image is formed by another image forming method.

While the above description has been described with reference to the particular illustrative embodiments, the present disclosure is not limited to the above embodiments. It is to be appreciated that those skilled in the art can change or modify the embodiments without departing from the scope and spirit of the present disclosure.

The invention claimed is:

1. A post-processing device comprising:

a carrying roller configured to be rotated to carry a sheet one by one to a processing tray along a conveyance direction;

a conveying member configured to convey the sheet carried by the carrying roller to a receiving position on the processing tray;

a transporting member configured to transport a stack of the sheets conveyed by the conveying member from the receiving position to a folding position via a binding position on the processing tray; and a processing part including a binding part configured to bind the stack of the sheets at the binding position and a folding part configured to fold the stack of the sheets at the folding position, wherein the conveying member includes at least one first conveying member arranged at an upstream side of the processing part and at least one second conveying member arranged at a downstream side of the processing part in the conveyance direction on the processing tray, each of the first and second conveying members has a rotation shaft and a plurality of contact pieces protruding from the rotation shaft so as to come into contact with the sheet carried on the processing tray, the contact piece being made of elastic material, and the conveying member is rotated at a rotation speed higher than a rotation speed of the carrying roller when the sheet carried by the carrying roller is conveyed to the receiving position on the processing tray.

2. The post-processing device according to claim 1, wherein the first conveying member and the second conveying member are synchronously rotated at the same speed.

3. The post-processing device according to claim 1, wherein the second conveying member is rotated at a rotation speed higher than a rotation speed of the first conveying member.

4. A post-processing device comprising:

a carrying roller configured to be rotated to carry a sheet one by one to a processing tray along a conveyance direction;

a conveying member configured to convey the sheet carried by the carrying roller to a receiving position on the processing tray;

a transporting member configured to transport a stack of the sheets conveyed by the conveying member from the receiving position to a folding position via a binding position on the processing tray; and a processing part including a binding part configured to bind the stack of the sheets at the binding position and a folding part configured to fold the stack of the sheets at the folding position, wherein the conveying member includes at least one first conveying member arranged at an upstream side of the processing part and at least one second conveying member arranged at a downstream side of the processing part in the conveyance direction on the processing tray, each of the first and second conveying members has a rotation shaft and a plurality of contact pieces protruding from the rotation shaft so as to come into contact with the sheet carried on the processing tray, the contact piece being made of elastic material, the conveying member is rotated at a rotation speed higher than a rotation speed of the carrying roller when the sheet carried by the carrying roller is conveyed to the receiving position on the processing tray, and the contact piece of the second conveying member has a length longer than the contact piece of the first conveying member.

5. The post-processing device according to claim 4, wherein the rotation shaft of each of the first and the second conveying members is rotated such that the contact piece is separated from the sheet carried to the processing tray when the transporting member transports the stack of the sheets to the binding position and the folding position.

6. The post-processing device according to claim 4, wherein the contact piece is fixed to an outer circumferential face of the rotation shaft in a manner to extend along a tangential direction of the outer circumference and arranged at the downstream side of the rotation shaft in the conveyance direction in a posture where the contact piece extends toward the processing tray from the rotation shaft.

7. The post-processing device according to claim 4, wherein the at least one first conveying member includes a plurality of first conveying members, the at least one second conveying member includes a plurality of second conveying members, a number of the plurality of second conveying members is larger than a number of the plurality of first conveying members.

8. The post-processing device according to claim 4, wherein a friction force of the contact piece of the second conveying member to the sheet is higher than a friction force of the contact piece of the first conveying member to the sheet.

9. A post-processing device comprising:

a carrying roller configured to be rotated to carry a sheet one by one to a processing tray along a conveyance direction;

a conveying member configured to convey the sheet carried by the carrying roller to a receiving position on the processing tray;

a transporting member configured to transport a stack of the sheets conveyed by the conveying member from the receiving position to a folding position via a binding position on the processing tray; and a processing part including a binding part configured to bind the stack of the sheets at the binding position and a folding part configured to fold the stack of the sheets at the folding position, wherein the conveying member includes at least one first conveying member arranged at an upstream side of the processing part and at least one second conveying member arranged at a downstream side of the processing part in the conveyance direction on the processing tray, each of the first and second conveying members has a rotation shaft and a plurality of contact pieces protruding from the rotation shaft so as to come into contact with the sheet carried on the processing tray, the contact piece being made of elastic material, the conveying member is rotated at a rotation speed higher than a rotation speed of the carrying roller when the sheet carried by the carrying roller is conveyed to the receiving position on the processing tray, and a sheet conveyance force of the second conveying member is larger than a sheet conveyance force of the first conveying member.

10. The post-processing device according to claim 9, wherein the second conveying member is rotated at a rotation speed higher than a rotation speed of the first conveying member.

11. The post-processing device according to claim 9, wherein the contact piece of the second conveying member has a length longer than the contact piece of the first conveying member.

12. The post-processing device according to claim 9, wherein the at least one first conveying member includes a plurality of first conveying members, the at least one second conveying member includes a plurality of second conveying members, a number of the plurality of second conveying members is larger than a number of the plurality of first conveying members.

13. The post-processing device according to claim 9, wherein a friction force of the contact piece of the second conveying member to the sheet is higher than a friction force of the contact piece of the first conveying member to the sheet.

* * * * *